United States Patent [19]

Lahtinen

[11] 4,244,685

[45] Jan. 13, 1981

[54] MEANS FOR AUTOMATIC CLOSING AND OPENING OF THE AIR INTAKE DUCT OF AN OIL BURNER

[75] Inventor: Paavo Lahtinen, Espoo, Finland

[73] Assignee: Nortti-Tuote Oy, Helsinki, Finland

[21] Appl. No.: 944,416

[22] Filed: Sep. 21, 1978

[51] Int. Cl.[3] ..... F23N 3/00

[52] U.S. Cl. ..... 431/265; 236/1 G; 415/157; 251/133; 137/38

[58] Field of Search ..... 431/381, 265; 236/1 G; 415/157; 251/133; 137/38

[56] References Cited

U.S. PATENT DOCUMENTS

| | | | |
|---|---|---|---|
| 2,215,272 | 9/1940 | O'Brien | 431/265 |
| 2,430,225 | 11/1947 | Hagler | 415/157 |
| 2,459,815 | 1/1949 | Hammell | 415/157 |
| 2,464,698 | 3/1949 | Logan | 431/265 |
| 2,464,699 | 3/1949 | Logan | 431/265 |

*Primary Examiner*—Carroll B. Dority, Jr.
*Assistant Examiner*—Lee E. Barrett
*Attorney, Agent, or Firm*—Shenier & O'Connor

[57] ABSTRACT

The shaft of an oil burner drive motor carries a plate and means responsive to stopping of the shaft for moving the plate axially of the shaft in a direction to close the air intake duct and responsive to starting of the shaft for moving the plate axially in a direction to open the air intake duct.

1 Claim, 1 Drawing Figure

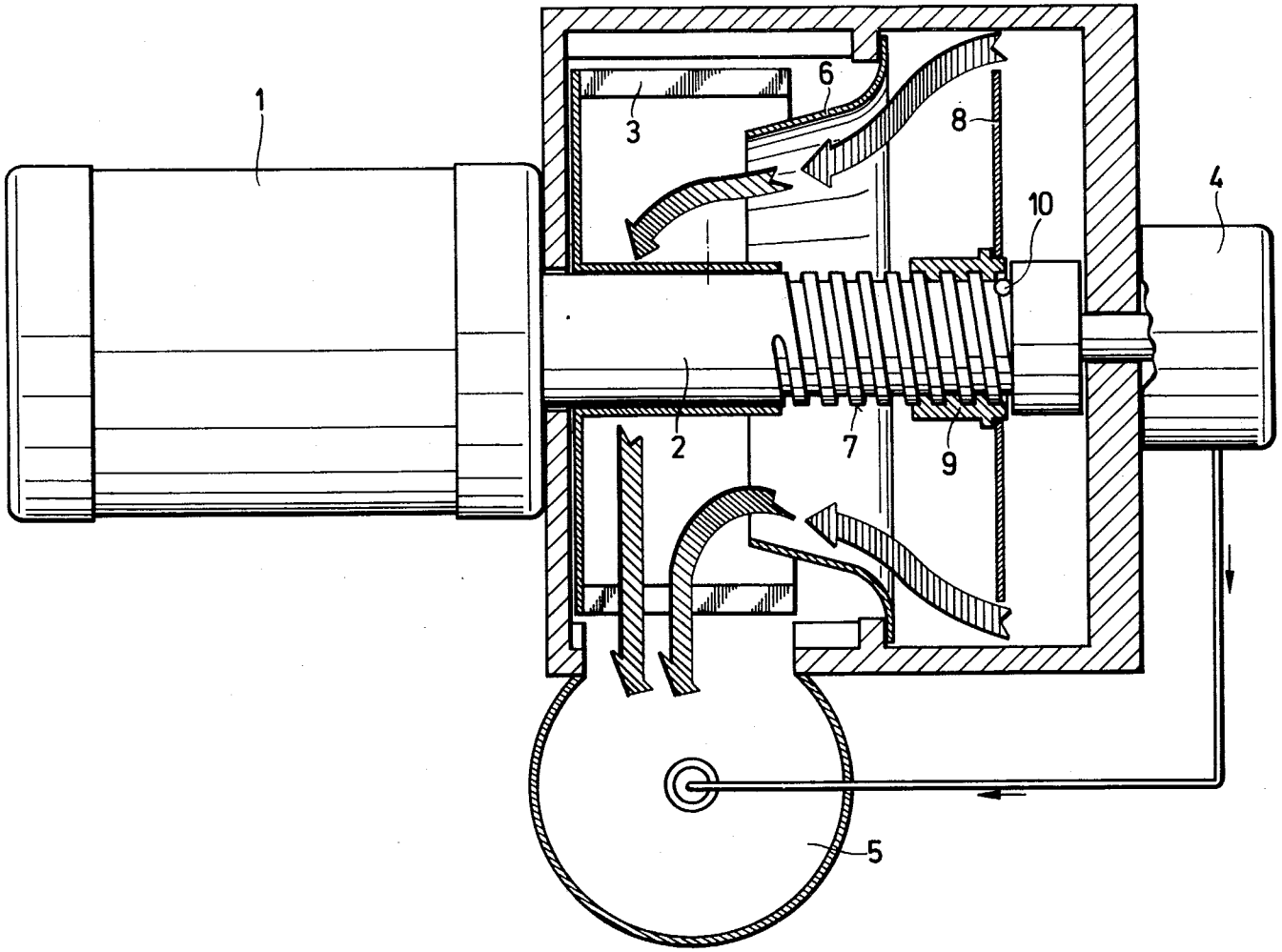
1
2
3
4
5
6
7
8
9
10

MEANS FOR AUTOMATIC CLOSING AND OPENING OF THE AIR INTAKE DUCT OF AN OIL BURNER

BACKGROUND OF THE INVENTION

The present invention concerns a means for automatically closing and opening the air intake duct of an oil burner as the burner stops and starts, said burner comprising a motor whence projects a shaft passing through the air intake duct, this shaft driving a fan and an oil pump, which feed air and oil into a mixer.

The problem encountered in oil burners of prior art is that the air duct remains open when the burner stops, whereby considerable air quantities pass through the firebox of the boiler, causing it to cool and resulting in appreciable loss of energy. The longer the non-operating times of the burner in proportion to the running periods, the greater will be the energy losses hereby incurred. If it were possible altogether to inhibit the air flow, this would mean in the heating of one-family houses and of small blocks of flats, in Finnish conditions and in the wintertime, a 12% oil saving and in the summertime a saving of 27%. Attempts have been made to prevent this cooling air flow e.g. by means of a damper mounted in the chimney and operated by a damper control motor. However, arrangements of this kind involve considerable detriments, one of them the risk that the damper fails to open or that it fails to close tightly, owing to soot and other dirt. In certain cases it has also happened that the pressure caused by heat rose to such high values that the ducts burst open explosively.

SUMMARY OF THE INVENTION

The object of the present invention is to eliminate the problem without any dampers mounted in the stack and with minimal cost so that closing and opening of the air duct take place automatically without requiring any extra energy or control.

This aim is achieved according to the invention in that on said shaft has been mounted a plate which moves axially by effect of the rotation or of the stopping of the shaft and which plate closes and opens the air duct.

In an advantageous embodiment of the invention, on the shaft has been provided a thread over which the inner thread in the hub of the plate fits to be freely rotatable thereon. Hereby as the motor and shaft stop, the plate will continue its rotation, whereby the thread causes it to move in axial direction until it abuts on the walls of the air duct, closing the air duct. Similarly, when the motor starts up, the plate will not immediately follow along owing to inertia, instead of which relative rotation will occur between the shaft and the plate and this will once again move the plate into the position in which it opens the duct.

DESCRIPTION OF THE DRAWING

The invention is described in greater detail in the following with reference to the attached drawing, which presents as a schematic sectional view the last-mentioned favorable embodiment of the invention.

DESCRIPTION OF THE PREFERRED EMBODIMENT

Shaft 2 of the motor 1 rotates the fan 3 and the oil pump 4, which feed air and oil into the mixer 5. The reference numeral 6 indicates an air duct, tapering conically or stepwise and ending at the cavity formed within the blades of the fan 3.

As taught by the invention, the shaft 2 has been provided with a thread 7, and a circular plate 8 has been arranged to be freely rotatable about the threaded part 7, on which it is carried by the hub 9 having an inner thread mating with the first-mentioned thread. When the motor 1 stops the plate 8 together with its hub 9 will continue to rotate, owing to the kinetic energy that is stored in it. The plate 8 will then move under the action of the thread 7 from right to left in the FIGURE and it will close the air duct 6. When the motor 1 starts to rotate, the plate 8 does not at once reach the same speed, whereby owing to the rotation of the shaft 2 and plate 8 relative to each other the plate 8 moves from left to right in the FIGURE, that is into the position shown in the FIGURE, thereby opening the air duct 6. It is possible to mount in the thread 7 an appropriate stop pin 10 with such shaping of the thread in the hub 9 that it will catch on this pin, whereby there will be no jamming and, in contrast, the plate 8 remains freely and easily rotatable.

The embodiment just described is not the only way in which the rotation of the shaft 2 may be utilized to shift the position of the plate 8. A well-usable embodiment is that in which the shaft 2 carries one of several substantially axial slide grooves or ridges which are engaged by a corresponding sliding ridge or groove on the hub 9 of the plate 8 and the plate 8 being provided with vanes which as the plate rotates will push it axially from left to right to open the duct 6. For returning the plate 8 to the position in which it closes the duct 6, one may provide for instance a comparatively sensitive spring, which is barely able to return the plate 8 into the position in which it closes the duct 6. In the embodiment shown in the drawing, too, vanes on the plate 8 may be employed to enhance the shifting, although it has been found in practical trials that the inertia force is enough to shift the plate 8. The spring returning the plate 8 is not absolutely necessary, because the air flow which one desires to inhibit by closing the air duct is strong enough to return the plate 8. Also centrifugal devices may be utilized to cause the movement of the disk 8 required to open the intake during rotation of the axle 2, whereby a spring, acting against the centrifugal device, may be used to close the intake when the rotation stops.

Having thus described my invention, what I claim is:

1. Apparatus for opening and closing the air intake duct of an oil burner having a motor provided with a shaft which extends through said air intake duct and which drives a fan and an oil pump which feed air and oil to a mixer, said apparatus comprising a duct section having a wall surrounding said shaft, said duct section being reduced in cross sectional area in one axial direction with reference to said shaft to provide a plurality of section portions of increasingly reduced cross sectional area in said direction, a plate, a hub carried by said plate for movement therewith, interengageable threaded means on said hub and on said shaft for mounting said plate on said shaft for movement in the direction of the axis thereof, the construction and arrangement being such that under the influence of a deceleration of said shaft said plate moves in said one axial direction and to abut said duct section wall to close said duct section upon stopping of said shaft and such that under the influence of an acceleration of said shaft said plate moves in a direction opposite to said one axial direction and to move away from said wall to open said duct section upon start up of said shaft.

* * * * *